United States Patent [19]

Singleton

[11] 4,032,881

[45] June 28, 1977

[54] RESISTANCE ELEMENT WITH IMPROVED LINEARITY AND METHOD OF MAKING THE SAME

[75] Inventor: Delbert Lowell Singleton, Riverside, Calif.

[73] Assignee: Bourns, Inc., Riverside, Calif.

[22] Filed: Feb. 6, 1976

[21] Appl. No.: 656,039

[52] U.S. Cl. ..... 338/195; 29/620; 338/174

[51] Int. Cl.[2] ..... H01C 10/00

[58] Field of Search ..... 338/195, 171, 174; 324/63; 29/593, 620; 219/121 L

[56] References Cited

UNITED STATES PATENTS

| | | | |
|---|---|---|---|
| 2,632,831 | 3/1953 | Pritikin et al. | 29/620 |
| 3,111,639 | 11/1963 | Ploke | 338/171 X |
| 3,772,631 | 11/1973 | Owen | 338/195 |
| 3,821,845 | 7/1974 | Kukee et al. | 29/620 X |
| 3,889,223 | 6/1975 | Sella et al. | 338/195 |

*Primary Examiner*—C. L. Albritton
*Attorney, Agent, or Firm*—Paul H. Ware; William G. Becker

[57] ABSTRACT

A highly accurate resistance element formed by depositing a plurality of conductive pads at spaced intervals along a substrate, depositing the resistance element in intimate electrical contact with the pads, sensing the electrical resistance between successive pairs of pads, and trimming away resistance material from the element between selected pairs of pads until predetermined resistance values between each pair are achieved. In a preferred embodiment a portion of each pad is offset from the resistance element and adapted to receive a probe from a laser trimmer. The element can be advantageously employed in potentiometers.

10 Claims, 6 Drawing Figures

RESISTANCE ELEMENT WITH IMPROVED LINEARITY AND METHOD OF MAKING THE SAME

BACKGROUND OF THE INVENTION

This invention relates to electrical resistance devices, and more particularly to devices having a resistance element which is trimmed to a predetermined resistance value, and to methods for making the same.

Resistance elements intended for use in a potentiometer or the like are frequently manufactured to a particular resistance value, within a given tolerance range, by depositing a resistive material having a resistance value less than the desired value onto a substrate. Portions of the resistive material are then removed from the resistance path until the desired value is achieved. Various devices, such as abrasive or grinding apparatus, are available for removing resistive material, although presently a laser is preferred where rapid trimming of a large volume of elements is required. A relatively simple trimming method entails the placement of sensors at opposite ends of the element to measure its total resistance, and then trimming until the measured resistance increases to the desired level. While adequate for applications in which the total resistance is of primary importance, this method does not provide sufficient linearity, i.e., a steady and regular increase in resistance as the element is traversed from one end to the other, required for certain applications such as high tolerance potentiometers.

A more sophisticated trimming method known in the prior art involves the placement of sensing probes at regular intervals along the length of the element, in effect dividing the element into a series of small resistance sections, and trimming to a desired resistance value for each section. Since each section is trimmed to a predetermined value within a given tolerance range, accurate placement of the sensing probes is obviously of great importance for this method. An early trimming technique employed probes which were physically moved from point to point along the element to sense the resistance of each section as it was trimmed. This technique, however, did not provide the consistent accuracy of probe placement required by high tolerance elements. A more recent approach, disclosed in U.S. Pat. No. 3,821,845 issued July 2, 1974, involves a contact point board of similar size and shape to the resistance element to be trimmed. Contacts are distributed along the board at intervals corresponding to the resistor sections and extend through the board from its upper to its under side. The board is placed over the element with the underside portion of each contact touching the element. The portions of the contacts on the upper side of the board are then connected to a laser control, enabling selected contacts to provide an indication of the section resistances as trimming proceeds. While this method can provide an accurate and repeatable placement of the contacts relative to each other, care must still be exercised to be sure that the board is placed in the same location over each element relative to the position of the elements themselves and their terminals. Also, the electrical connection between each contact and the element may be imperfect, thereby introducing a contact resistance that will throw off the accuracy of the readings obtained from the contacts. In addition, this method requires the separate manufacturing step of emplacing the contact board.

SUMMARY OF THE INVENTION

In view of these and other problems associated with the prior art, it is an object of the present invention to provide a novel and improved resistance element having a very high and repeatable level of linearity and a method for making the same.

Another object is the provision of such a resistance element and method in which individual sections of the element are each trimmed, and without introducing any appreciable contact resistance in the apparatus used to sense the resistance of each section.

A further object is the provision of such a resistance element and method in which the cost and complexity of the equipment used to sense the resistance of successive sections are significantly reduced.

In the accomplishment of these and other objects of the invention, a plurality of spaced conductive contact pads are fixedly distributed along a substrate in intimate electrical contact with a resistance element, each of the pads presenting a contact area for a trimming probe. Resistance material is then trimmed away from the element between slected pairs of pads until predetermined resistance values between each of the pairs are achieved, the resistance between each pair of pads being sensed by applying sensing probes to the pads.

In a particular embodiment the contact pads, including terminations for the resistance element, are distributed along an edge of the element with a first portion of each pad offset from the element and adapted to receive a trimming probe, and a second portion of each pad in intimate physical contact with an overlying resistance element. The resistance value sensed between each pair of pads is used to control a laser beam which performs the trimming operation.

DESCRIPTION OF THE DRAWINGS

Further advantages and features of the invention will be apparent to those skilled in the art from the ensuing detailed description thereof, taken together with the accompanying drawings, in which.

DETAILED DESCRIPTION

Figure 1:
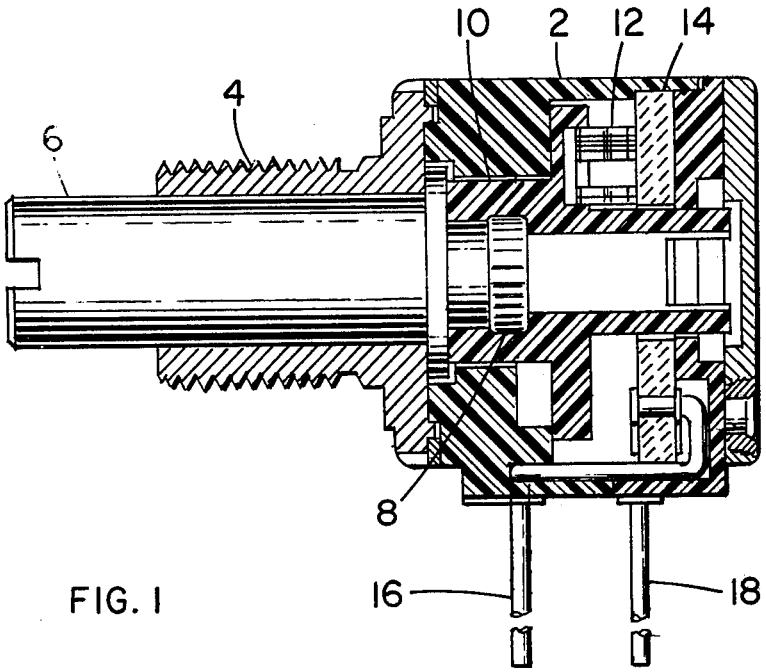
FIG. 1 is a cross-sectional view of a potentiometer employing the improved resistance element of the invention.

Referring to FIG. 1, a typical potentiometer employing a resistance element is shown. The potentiometer illustrates an environment in which the improved element of the present invention may be advantageously employed, but it should be understood that its details of construction outside of the resistance element and substrate assembly in no way limit the scope of the invention. Also, the term "potentiometer" is intended herein to include variable resistors in general. The potentiometer includes a housing 2 having a bushing 4 through which a control shaft 6 having a knurled ring 8 at its end extends. A rotor 10, seated over ring 8 and constrained thereby to rotate with control shaft 6, carries a wiping spring 12 which wipes against and electrically bridges a resistance element and collector deposited on a facing surface of substrate 14. Alternately, spring 12 could wipe the resistance element alone and be connected by wire to a collector. Terminals pins 16, 18, and a third pin not shown in the drawing are connected to the substrate 14 in respective contact with each end of the resistance element and with the collector.

Figure 2:
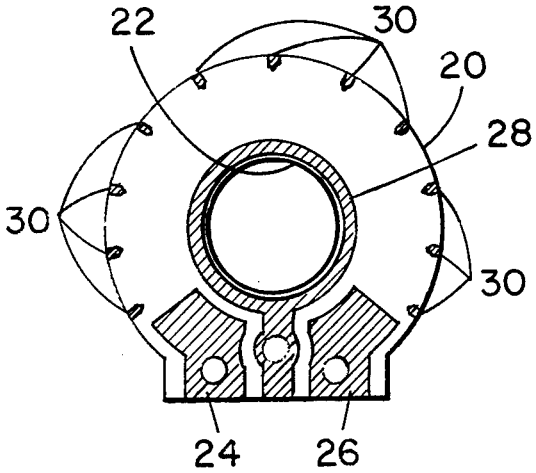
FIGS. 2, 4 and 6 are plan views of a resistance element in sequential stages of construction, showing respectively a substrate for the element with conductive contact pads and terminals deposited thereon, a resistance element deposited on the substrate and overlying portions of the pads and terminals, and the substrate assembly after the resistance element has been trimmed.

The substrate assembly at an initial state of manufacture is shown in FIG. 2. Substrate 20 is formed from an insulative material and is shown as generally circular in shape, although the principle of the invention is equally applicable to other substrate shapes, such as linear or helical. An opening 22 is formed through the middle of the substrate to accommodate an extension of the potentiometer rotor. Conductive terminal pads 24 and 26 for the resistance element and a conductive collector ring 28 which surrounds opening 22 and extends to the edge of the substrate between pads 24 and 26 are deposited onto a surface of the substrate. The deposition may be achieved by silkscreening followed by heat curing. A plurality of small pads 30 formed from the same conductive material as terminals 24 and 26 and collector 28 are distributed around the periphery of the substrate. Eleven such pads are shown at equidistant spacings in the drawing, although the exact number and placement of the pads can be varied according to the desired linearity of the resistance element. All of the conductive parts shown in FIG. 2 are preferably deposited onto the substrate at the same time, thereby assuring accurate placement of the pads 30 relative to the terminal pads 24 and 26.

Figure 3:
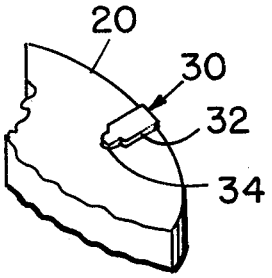
FIG. 3 is an enlarged fragmentary perspective view showing one of the conductive contact pads deposited on the substrate.

Each of the pads 30 is substantially identical in shape, an enlargement of one of the pads shown in FIG. 3. It is seen that the pad consists of a first, relatively large body portion 32 having a generally rectangular shape and situated adjacent to the edge of substrate 20, and a second relatively smaller head portion 34 on the inward side of portion 32 from the substrate edge. Head portion 34 is reduced in size to minimize electric field effects in the resistance element, while body portion 32 is sufficiently large to form a receiving surface for a trimming probe.

Figure 4:
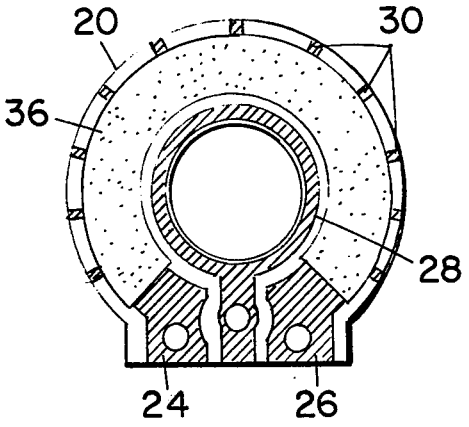

FIG. 4 shows the substrate assembly of FIG. 2 with a generally circular resistance element 36 deposited onto substrate 20 so as to overlie and hide from view the contact pad head portions 34 and the inner ends of terminal pads 24 and 26. The outer edge of element 36 is offset from the corresponding outer substrate edge and the larger pad portions 32, leaving those portions exposed for contact by trimming probes. Resistance element 36 is preferably deposited by a screening and curing process similar to that for the conductive members, whereby an intimate physical and electrical contact is achieved between it and the pad head portions 34 and terminals 24 and 26.

Figure 5:
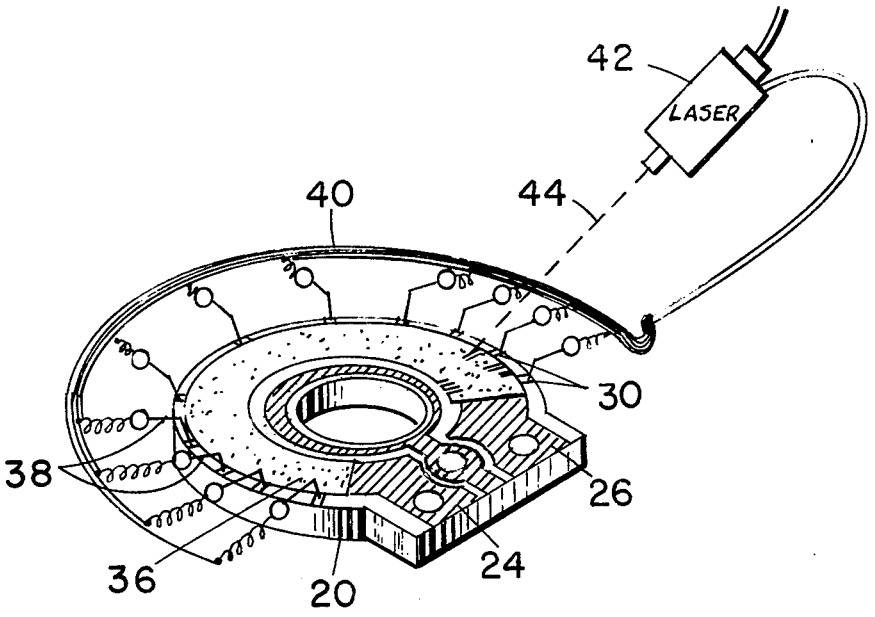
FIG. 5 is a perspective view illustrating a laser controlled in accordance with the invention to trim the resistance element.

FIG. 5 illustrates one manner of trimming the resistance element to a precise resistance value with a very high degree of linearity along the resistance path. Sensing probes 38 are placed against the exposed portions 32 of each of the contact pads 30. The probes 38 are connected via wires 40 to the control for a laser 42. Methods of controlling a laser beam are well known and form no part of the present invention, so the exact control mechanism is not shown. It should be noted, however, that although the wires 40 are shown as being connected directly to the laser, in actuality they might control mirrors which direct the beam after it has been emitted from the laser. The laser beam 44 in initially directed at the section of the resistance element 36 between the first and second contact pads 30 from one of the terminal pads, and trims away resistance material until the resistance of that section, as sensed by the probes, reaches a predetermined desired value. Of course, since absolute accuracy is extremely difficult to achieve, the term "predetermined resistance value" as used herein refers to a resistance value within a given tolerance range. The laser beam is then directed onto the next element section, between the second and third of pads 30, and trims that section until its desired resistance value is achieved. The beam is then moved on to trim the section between the third and fourth of pads 30, and so on until the entire element has been trimmed. In the embodiment shown, the laser beam is directed to make up to three cuts inwardly from both the inner and the outer edges of element 36 for each resistance section, the number and length of cuts determining the amount of resistance material trimmed away from each section and thereby its final resistance value. The wiping spring preferably contacts the element only along the path left between the inner and outer cuts. In addition to enhancing the wiping contact, this offsets the spring from the contact pad head portions 34 to further reduce any electric field effects. Various other trimming techniques are known and may also be used; the invention is not limited to any particular technique. For example, sensing probes could be positioned on terminals 24 and 26 and trimming conducted with these terminals functioning as additional pads. In this approach it may be desirable to measure from a constant reference at one of the terminals to each of the pads in succession and finally to the opposite terminal, trimming each section according to the total resistance back to the reference terminal. Also, in accordance with known trimming methods, a continuous laser cut could be made rather than a series of discrete cuts as shown in FIG. 5, the length and shape of the cut at each section being determined by the sensed resistance of that section. In addition, it is not necessary to trim each section in the order of its location on the substrate, as described above. Other sequences may be employed, such as first trimming those sections with the greatest divergence from the desired resistance value, or trimming the sections in a series of iterations.

While the above described trimming techniques refer to sensing the "resistance" of each section, in actuality it is the voltage across or the current through the sections that is measured. With either a measured voltage from a known current source or a measured current from a known voltage source, the resistance of each section can be computed. Sometimes, however, knowing either the voltage or the current but not both may be sufficient, in which cae the only knowledge that can be obtained as to the resistance of a section is its value relative to that of the other sections, rather than its absolute value. This is the situation when only the voltage across or current through the sections is measured, without being related back to the current or voltage source, as when optimum linearity is of much greater importance than a precise total resistance value. This situation is still within the scope of the invention, and accordingly the term "resistance" as used in this specification should be understood to refer not only to absolute resistance but also the the relative resistance of a section with respect to the other sections.

Figure 6:
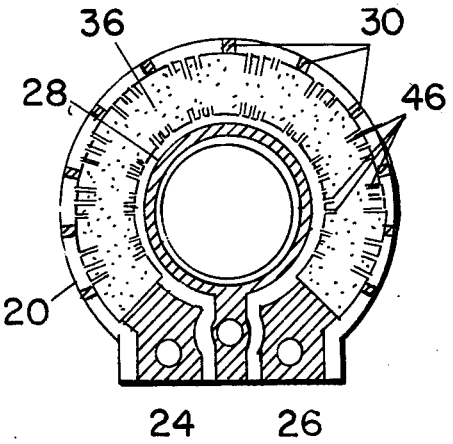

A completed substrate assembly suitable for incorporation into a potentiometer is shown in FIG. 6. Laser cuts 46 of various lengths have been made between successive pairs of pads 30, producing an element with both a total resistance and an incremental resistance between successive pairs of pads that is highly accurate. The fixed deposition of pads 30 eliminates problems previously associated with positioning the trimming probes 38, since the probes can be placed anywhere on the exposed portions 32 of the pads without changing the length or location of the resistance sections sensed. Contact resistance problems are held to minimum since the pads 30 and resistance element 36 are maintained firmly in contact over relatively broad areas, and the probes 38 contact the highly conductve pads 30 (and termination pads 24 and 26, if desired). The cost of producing the substrate assembly is also reduced by eliminating much of the setup time previously required to accurately position trimming probes, and also by eliminating auxiliary probe equipment.

While a particular embodiment of the invention has been shown and described, numerous additional modifications and variations are possible in light of the above teachings. For example, the sequence of depositing the resistance element and contact pad could be reversed, with the element being deposited first and the pads being placed over the element, either entirely or in part. Furthermore, although the achievement of high linearity has been stressed as being of significant commercial importance, non-linear elements could be produced by programming the laser apparatus accordingly, the important feature being that trimming of selected sections of the resistance element can be performed accurately and economically. It is therefore intended that the scope of the invention be limited only in and by the terms of the appended claims.

What is claimed is:

1. In a potentiometer having an insulative substrate, a resistance element deposited thereon, a collector, a wiper means electrically connecting said element and collector, and termination means associated respectively with said element and collector, wherein the improvement comprises:

resistance adjusting means for trimming said resistance element including a plurality of spaced conductive pads fixedly distributed along said substrate in intimate electrical contact with said resistance element, each of said pads presenting a contact area for a trimming probe, and said resistance element being trimmed to predetermined resistance values between each of said pads.

2. The potentiometer of claim 1, wherein said contact pads are distributed along an edge of said element.

3. The potentiometer of claim 2, wherein an edge of said resistance element is offset from a corresponding edge of said substrate, and said contact pads are distributed on said substrate along said element edge.

4. The potentiometer of claim 3, each of said pads comprising a first portion offset from said resistance element and adapted to receive a trimming probe, and a second portion in intimate physical and electrical contact with said resistance element.

5. The potentiometer of claim 4, wherein said resistance element overlies said second pad portions.

6. A highly accurate electrical resistor comprising:

an insulative substrate, a resistance element deposited on said substrate, and resistance adjusting means for trimming said resistance element including a plurality of spaced conductive pads fixedly distributed along said substrate in intimate electrical contact with said resistance element, each of said pads presenting a contact area for a trimming probe, said resistance element being trimmed to predetermined resistance values between each of said pads.

7. The resistor of claim 6, wherein said contact pads are distributed along an edge of said element.

8. The resistor of claim 7, wherein an edge of said resistance element is offset from a corresponding edge of said substrate, and said contact pads are distributed on said substrate along said element edge.

9. The resistor of claim 8, each of said pads comprising a first portion offset from said resistance element and adapted to receive a trimming probe, and a second portion in intimate physical and electrical contact with said resistance element.

10. The resistance of claim 9, wherein said resistance element overlies said second pad portion.

* * * * *

UNITED STATES PATENT OFFICE

CERTIFICATE OF CORRECTION

PATENT NO. : 4,032,881

DATED : June 28, 1977

INVENTOR(S) : Delbert Lowell Singleton

It is certified that error appears in the above-identified patent and that said Letters Patent are hereby corrected as shown below:

Column 4, Line 7, "in" should be -- is --

Column 4, Line 62, "cae" should be -- case --

Column 5, Line 5, "also the the" should be -- also to the --

Column 5, Line 18, insert -- a -- after "held to"

Column 6, Line 47, "The resistance" should be -- The resistor --

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*